United States Patent [19]

Moriya

[11] Patent Number: 4,615,625

[45] Date of Patent: Oct. 7, 1986

[54] ANALOG ELECTRONIC TIMEPIECE

[75] Inventor: Tatsuo Moriya, Suwa, Japan

[73] Assignee: Seiko Epson Kabushiki Kaisha, Tokyo, Japan

[21] Appl. No.: 603,372

[22] Filed: Apr. 24, 1984

[30] Foreign Application Priority Data

Apr. 28, 1983 [JP] Japan ..... 58-75888

[51] Int. Cl.[4] ..... G04F 5/00; G04B 1/00

[52] U.S. Cl. ..... 368/156; 368/204

[58] Field of Search ..... 368/69, 80, 85, 86, 368/155-156, 159, 203-204

[56] References Cited

U.S. PATENT DOCUMENTS 3,828,278 8/1974 Rees ..... 368/204 X
3,830,052 8/1974 Daniels et al. ..... 368/156
3,916,612 11/1975 Morokawa et al. ..... 368/80
4,039,973 8/1977 Yamashiro ..... 368/159 X
4,103,187 7/1978 Imamura ..... 368/156
4,130,988 12/1978 Scherrer et al. ..... 368/86
4,177,632 12/1979 Burki et al. ..... 368/187
4,328,571 5/1982 Noble ..... 368/87

*Primary Examiner*—Vit W. Miska
*Attorney, Agent, or Firm*—Blum Kaplan Friedman Silberman & Beran

[57] ABSTRACT

An analog electronic timepiece wherein oscillation of the oscillator circuit is stopped when the watch is placed into a reset mode. This lowers power consumption and provides for greater battery life during shipping and stocking periods. In one embodiment of the invention the oscillator is stopped immediately upon placing the watch into a reset mode. In another embodiment of the invention, cessation of oscillation does not occur until a predetermined delay after reset.

20 Claims, 9 Drawing Figures

ANALOG ELECTRONIC TIMEPIECE

BACKGROUND OF THE INVENTION

This invention relates generally to an analog electronic timepiece and more particularly to an analog electronic timepiece containing a mechanism which stops the oscillation of an oscillator circuit when the timepiece is placed into a reset mode. This feature is useful for reducing power consumption and extending battery life.

A problem exists with the power consumption of analog electronic timepieces during shipping and stocking periods. If a watch is shipped with a battery installed, the useful life of the battery is shortened by an amount of time equal to the time the watch spends in transit and storage. In some instances the interval of time between the purchase of the timepiece and the end of its initial battery life is quite short. In the design of analog electronic timepieces it has been known to stop the operation of the stepping motor which moves the watch hands, by disabling it when the watch is placed into a reset mode. This provides an amount of power economy. However, using current technology, the power consumption required for the operation of a stepping motor has been reduced to approximately 0.8 to 1.6 microwatts per step or rotation. With reference to an electronic timepiece utilizing a stepping motor which has two hands, an hour and a minute hand, and whose hands advance one step every ten seconds, the power consumption of the stepping motor is approximately 0.08 to 0.16 microwatts per second. In an electronic timepiece having two hands whose hands advance one step every twenty seconds, the power consumption is approximately 0.04 to 0.08 microwatts per second. In contrast, the power consumption of the electronic watch circuit itself is approximately 0.2 microwatts during normal operation even allowing for the latest developments in integrated circuit technology. Additionally, any switch which is used to place the analog watch in a reset mode is generally provided with a pull up or pull down resistor, and this will also consume power.

Therefore, even if an analog electronic timepiece is placed in a reset mode and the power to the stepping motor is removed, the extension of battery shelf life will be minimal. In particular, in an analog electronic timepiece having only two hands, little power is saved. In fact, in some instances more power is consumed during reset than during normal operation.

Accordingly, it is desirable to provide an analog electronic timepiece which eliminates the above mentioned shortcomings by stopping oscillation of the oscillator circuit and reducing power consumption of the electronic circuit when the watch is in a reset mode in order to lower power consumption during shipping and stocking periods and to provide an analog electronic timepiece having an extended battery life.

SUMMARY OF THE INVENTION

Generally speaking, in accordance with the invention, an improved analog electronic timepiece is provided. The timepiece includes an oscillator circuit which generates a high frequency time standard, a divider circuit which takes the high frequency signal from the oscillator circuit and converts it to a plurality of low frequency wave forms and a driving pulse generator which receives a low frequency output of the divider circuit and generates signals which are used to drive a stepping motor assembly connected to analog hands. The oscillator circuit is provided with a gating circuit which allows the oscillator to be turned on and off by the application of a control signal. Additionally, the driving pulse generator is also provided with a gating circuit to prevent its reception of low frequency timekeeping signals when a system reset control signal is applied. In one embodiment of the invention, when the time setting stem of the electronic timepiece is pulled out, a system reset control signal is supplied to both the oscillator gating circuit and driving pulse generator gating circuit to stop the oscillator and halt the stepping motor effectively reducing power consumption of the electronic watch to zero.

In another embodiment of the invention, a counter and reset circuit are provided coupled to the system reset control signal and the oscillator and driving pulse generator gating assemblies. In this embodiment, when a system reset control signal is provided by the watch stem, the stepping motor is halted immediately. However, the oscillator is allowed to continue to run for a predetermined period of time. In this way, oscillation is not halted when it is only desired to set the watch, but oscillation is halted when the watch is being shipped or stored. This results in the maintenance of greater time keeping accuracy.

In still a further embodiment of the invention, an increased current is applied to the stopped oscillation circuit upon restart. The oscillator circuit may be additionally provided with an externally controlled inverter circuit which is controlled by a logic array which senses the release of the system reset control and appropriately applies an additional pulse of current to the stopped oscillator circuit allowing it to begin oscillation after reset in a more immediate manner.

Accordingly, it is an object of the invention to provide an improved analog electronic timepiece.

Another object of the invention is to provide an improved analog electronic timepiece including a reset mechanism for stopping the oscillator and stepping motor when the watch is placed in a reset mode.

A further object of the invention is to provide an improved analog electronic timepiece wherein the stepping motor is stopped immediately after the watch is placed in a reset mode and the oscillator mechanism is stopped after a predetermined period of time.

Still another object of the invention is to provide an improved analog electronic timepiece which uses little or no energy when it is being shipped or stored.

Still other objects and advantages will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
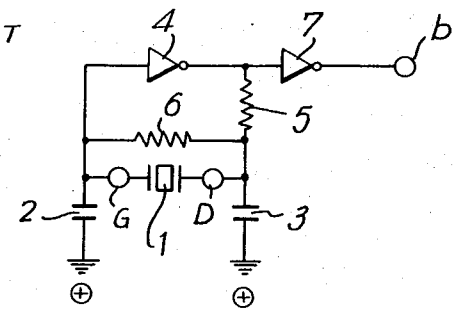
FIG. 1 PRIOR ART
FIG. 1 is a circuit diagram showing a conventional quartz crystal oscillator circuit.

Referring now to FIG. 1, a circuit diagram of a conventional quartz crystal oscillator is shown. A quartz crystal vibrator 1 has a gate terminal G and a drain terminal D respectively coupled through a gate capacitor 2 and drain capacitor 3 to a power source. A DC bias resistor 6 is connected across quartz crystal vibrator 1. A phase shift resistor 5 is connected between the drain terminal of a quartz crystal vibrator 1 and the output of an inverter 4. The input of inverter 4 is connected to gate terminal G. The output of inverter 4 is applied to the input of inverter 7 for wave shaping. The output signal of inverter 7 is applied to terminal 6 as a high frequency time standard.

Figure 2A:
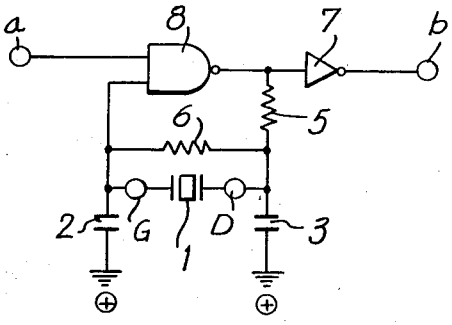
FIG. 2*a*–FIG. 2*d* are circuit diagrams showing embodiments of quartz crystal oscillator circuits made in accordance with an embodiment of the invention.

Referring now to FIG. 2*a* a circuit diagram illustrating an oscillator manufactured in accordance with an embodiment of the invention is shown, like reference numerals being applied to like elements in this and the other oscillator circuits of the following figures. In FIG. 2*a*, inverter 4 of FIG. 1 is replaced by a NAND gate 8. One of the iputs to NAND gate 8 is tied to control terminal "a" while the other is coupled to gate terminal G. The NAND gate operates like an inverter when its "a" input is high and stops oscillation of quartz crystal 1 when its "a" input is low.

Figure 2B:
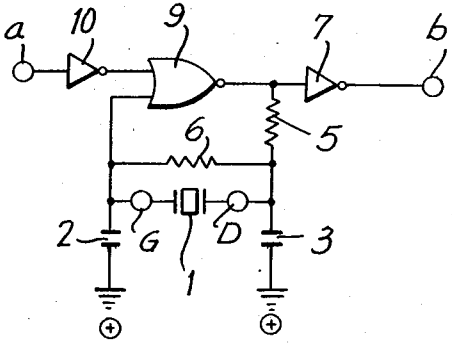

Referring now to FIG. 2*b* a second circuit diagram is shown wherein inverter 4 of the conventional oscillator of FIG. 1 is replaced by a NOR gate 9 and an inverter 10. The input to inverter 10 is tied to control terminal "a". The output of inverter 10 is applied as one input of NOR gate 9 while the other input to the NOR gate is coupled to gate terminal G. When the "a" input to the oscillator is held in a high logic state, oscillation through NOR gate 9 is permitted. However, when control terminal "a" is pulled low oscillation of quartz crystal 1 is halted.

Figure 2C:
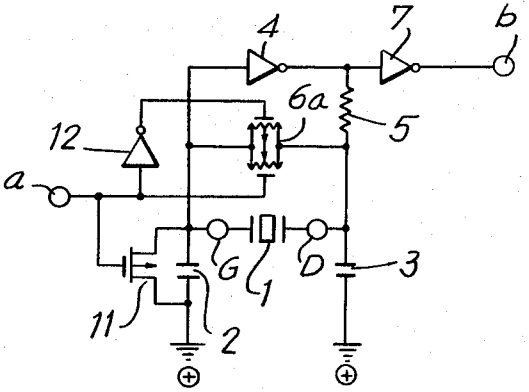

Referring now to FIG. 2*c*, a third embodiment of an oscillator in accordance with the invention is shown. In FIG. 2*c*, the DC bias resistor 6 of FIG. 1 is replaced by a DC bias resistor assembly 6*a* composed of back to back P-type and N-type MOS transistors having their respective source-drain paths, which are designed to provide the desired restart when conducting, connected in parallel between the gate and drain terminals G and D. A control terminal "a" is converted to the gates of the N-type transistor of DC bias resistor assembly 6*a* and of a P-type conventional or MOS transistor 11. MOS transistor 11 is connected across gate capacitor 2. Additionally, an inverter 12 having its input coupled to control terminal "a" is provided across DC bias resistor assembly 6*a* and gate condenser 2 and its output coupled to the gate of the P-type MOS transistor of DC bias esistor assembly 6*a*. When the "a" control line input goes high, crystal oscillator 1 can oscillate and when control line "a" is pulled low, oscillation is halted by the shortening of gate capacitor 2 and the rendering non-conductive of DC bias resistor assembly 6*a*.

Figure 2D:
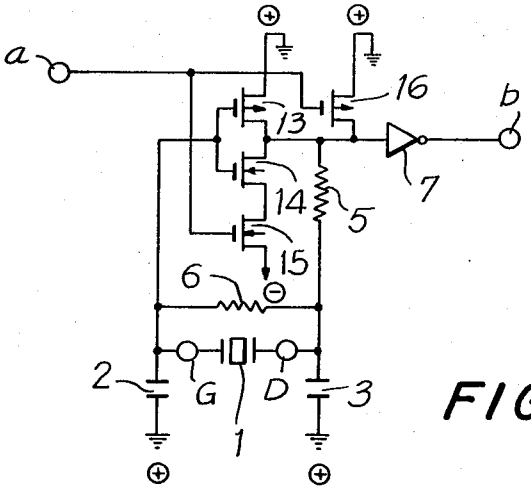

Finally, referring to FIG. 2*d*, a fourth embodiment of an oscillator manufactured in accordance with the invention is shown. In this configuration, inverter 4 of the conventional oscillator is replaced by complementary coupled P-type MOS transistor 13 and an Ntype MOS transistor 14. An additional N-type MOS transistor 15 is provided with its source drain path in series with the source-drain path of MOS transistor 14 to control the oscillation of transistors 13 and 14, the gate of MOS transistor 15 being tied to control terminal "a". An additional P-type MOS transistor 16 is provided to control the output of the oscillator circuit its gate being coupled to control terminal "a" and its source-drain path being coupled between a positive power source and the input to inverter 7. When the "a" control terminal is set to a high state, oscillation is allowed and when the "a" control terminal is pulled to a low state oscillation is prohibited.

In the above noted embodiments, oscillation is stopped when the "a" control line is brought low. The result is that in FIG. 2*a* oscillation is stopped since the output of NAND gate 8 is forced to a high condition; in FIG. 2*b* oscillation is stopped since the output of NOR gate 9 is forced to a low condition; in FIG. 2*c* oscillation is stopped since the DC bias resistor assembly 6*a*, becomes non-conductive and additionally the P-type MOS transistor 11 turns on setting the gate terminal to a high condition; and in FIG. 2*d* oscillation is stopped since the N-type MOS transistor 15 turns off thereby floating the power supply level of the inverter made up of transistors 13 and 14, and additionally oscillation is stopped since P-type MOS transistor 16 turns on and the input of inverter 7 is forced to a high condition.

It is to be noted that other circuit embodiments may be used for halting oscillation. In a preferred embodiment, quartz crystal vibrator 1, gate capacitor 2, drain capacitor 3, inverter 4, phase shift resistor 5, bias resistor 6 and inverter 7 of the conventional oscillator circuit are all inoperative when the "a" control line is brought low and oscilation is ceased. Additionally, it is preferred that when oscillation is halted the input to inverter 7 is not left to float, but is set to either a high or low logic condition.

Figure 3:
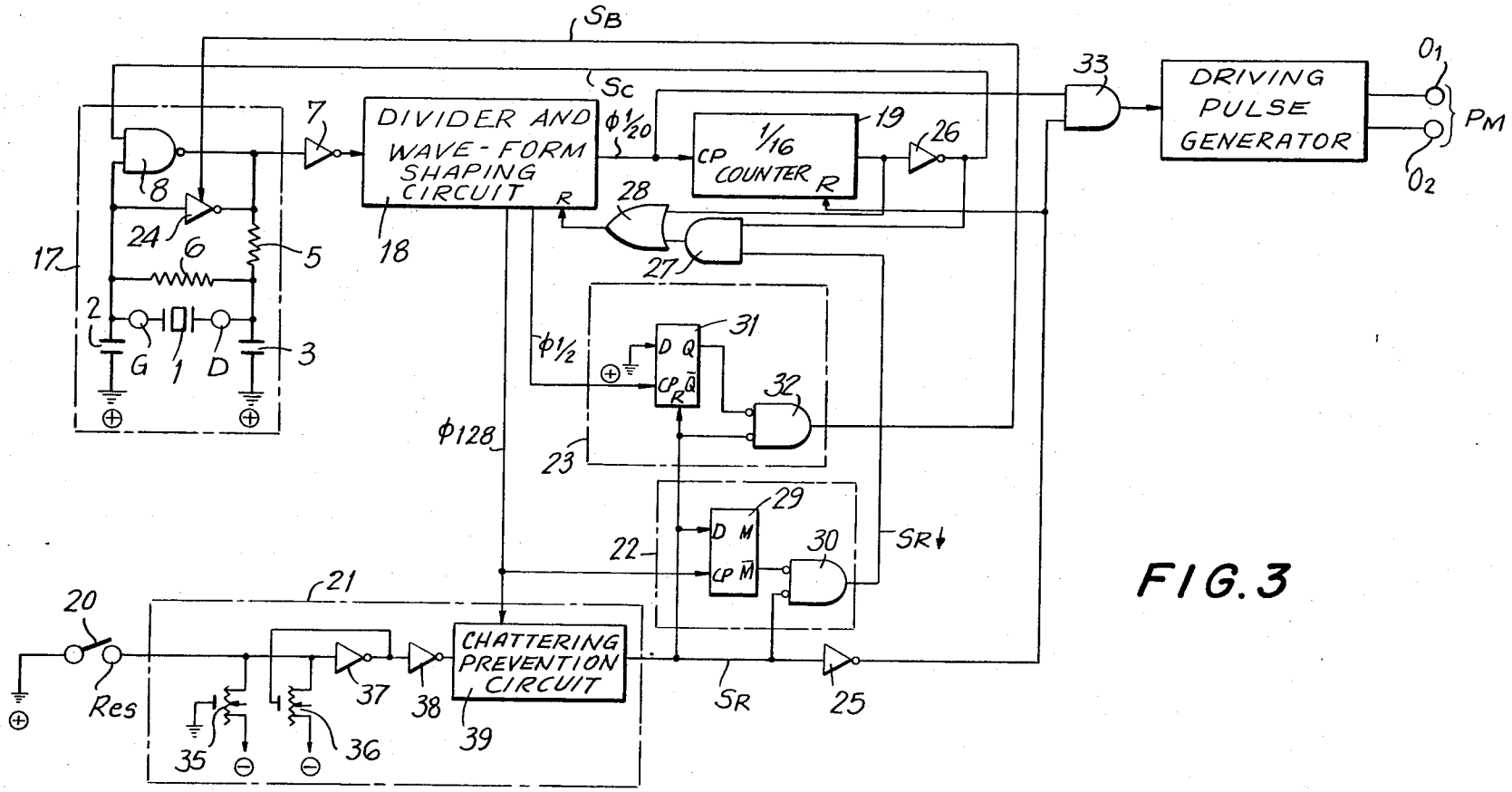
FIG. 3 is a block schematic diagram of the electronic circuit of an analog electronic timepiece made in accordance with the invention.

Referring now to FIG. 3, a block schematic diagram of an electronic circuit for an analog electronic timepiece in accordance with the invention is shown. The timepiece is provided with an oscillator circuit 17, the output of which is coupled to a divider and wave form shaping circuit 18 (hereinafter "divider circuit 18"). The once every 20 second output ($\phi 1/20$) of divider circuit 18 is applied to both the input of a 1/16 counter circuit 19 and to one input of an AND gate 33. AND gate 33 acts as a switch to control the flow of low frequency timing signals from divider circuit 18 to a driving pulse generator 34. The outputs $O_1$ and $O_2$ (signal $P_m$) of pulse generator 34 are connected to a stepping motor (not shown) or other suitable analog hands driving mechanism. The analog electronc timepiece circuit also includes a switch 20 which may operate off the stem (not shown) of the electronic timepiece and which provides a signal to the input of a reset signal shaping circuit 21. The output of reset signal shaping circuit 21 is connected to a differentiation circuit 22 and to a timer circuit 23. These circuits are utilized in generating signals to halt, reset and restart oscillator circuit 17 and divider circuit 18. Additionally, the output of reset signal shaping circuit 21 is passed through an inverter 25 to reset 1/16 counter 19 to provide the second input to AND gate 33 for controlling driving pulse generator 34.

In differentiation circuit 22, a D-type latch circuit 29 transfers its D input from reset signal shaping circuit 21 to its M output when its clock pulse input $C_P$ is low and latches the M output when the clock pulse input $C_P$ is high. The M output of latch circuit 29 and the $S_R$ output of reset shaping circuit 21 are applied to NOR gate 30 to produce the $S_R$ output. In timing circuit 23, a D-type latch circuit 31 makes its Q output low, regardless of its D input, when its reset input R is held high, and passes its D input through to its Q output on the rising edge of a clock pulse input $C_p$ when the reset input R is held low. The Q output of latch circuit 31 and the $S_R$ output of reset shaping circuit 21 are applied to NOR gate 32 to produce the $S_B$ output. It is further noted that the oscillator circuit 17 is the same as the oscillator circuit shown in FIG. *2a* with the addition of an inverter 24 with its input connected to gate terminal G and its output connected to the input of inverter 7. Inverter 24 operates when the $S_B$ signal from timer circuit 23 is in a high condition.

Divider and wave shaping circuit 18 takes an input of approximately 32,768 Hz and generates three outputs: a 128 Hz signal with a $\frac{1}{4}$ duty cycle ($\phi$128) a differential signal output ($\phi\frac{1}{2}$) once every two seconds ($\frac{1}{2}$ Hz) with a pulse width of 1.95 milliseconds; and a differential signal output once every twenty seconds (1/20 Hz) with a pulse width of 1.95 milliseconds. The divider and waveform shaping circuit 18 also has a reset input R which resets all of its internal counters when the reset input is held high.

Referring now to the 1/16 counter 19 it too has a reset input R which holds the counter in a reset state and places its output in a low state when the reset line is driven high. The 1/16 counter contains four two state flip flops and takes an input of a single pulse every twenty seconds from 1/20 Hz output of divider circuit 18. After counting 16 pulses, the output of 1/16 counter 19 goes high until reset.

Referring now to the user control interface, and reset signal generator 21, the time setting stem (not shown) of a watch is provided with a switch 20 which is open when the stem is pushed in and which is closed when the stem is at a first pulled out position. In this first pulled out position the time on the analog display portion of the watch may be set. Switch 20 controls the input to the reset signal generator 21 at the Res terminal. The reset signal generator contains a pull down resistor 35 in the form of a MOS transistor which is always active when the watch stem is pushed in so that switch 20 is open. Switch 20 and said pull down resistors are connected to the input of inverters 37, the output of which is connected to the input of inverter 38. The output of inverter 38 is applied to a chattering prevention circuit 39. The output of chatter prevention circuit 39 is a system reset control signal $S_R$ which corresponds directly to the logic condition of input switch 20. It is noted that the system reset control signal $S_R$ is synchronized with the rising edge of the 128 Hz output ($\phi$128) of divider circuit 18.

The system also outputs the following signals: Differentiation circuit 22 differentiates the pulse rate of the reset signal $S_R$ to 1.95 milliseconds by the 128 Hz signal on the falling edge of an $S_R$ signal and outputs a new signal $S_R\downarrow$. Timer circuit 23 outputs a signal $S_B$ which takes on a high logic value at the moment that the $S_R$ signal falls and stays high until the $\frac{1}{2}$ Hz signal goes high. The $S_B$ signal is low during all other times. It is additionally noted that AND gate 33 passes a single pulse every twenty seconds only when system reset signal $S_R$ is low. It, in turn, outputs a motor driving pulse $P_M$ with a pulse width of 6.8 milliseconds which drives a stepping motor in response to the 1/20 Hz signal.

Referring now to FIG. 3 operation of the improved analog electronic timepiece is explalined. When the stem is pushed in switch 20 becomes open and the reset terminal Res is pulled to a low logic state through pull down resistors 35 and 36. After cleaning up the signal through chatter prevention circuit 39, the system reset control signal $S_R$ also becomes low and its inverse $S_R\downarrow$ is found at the output of inverter 25. This high inverse system reset control signal $S_R$ resets the 1/16 counter 19 by driving its reset input high. In turn this drives the output of the 1/16 counter low and this low signal is inverted by inverter 26 to provide a high signal to the "a" control input of NAND gate 8. At this point NAND gate 8 is equivalent to a standard inverter and oscillator circuit 17 performs a regular operation. Since the system reset control signal $S_R$ and the output from the 1/16 counter 19 are low, the output from NOR gate 28 applied as the reset input to divider circuit 18 is held low, allowing the divider circuit to operate normally. Additionally, since the output of inverter 25 is the inverse of the system reset control signal, a high signal is provided to driving pulse generator AND gate 33 allowing 1/20 Hz driving pulses to pass through to driving pulse generator 34. Therefore, when the stem is pushed in the stepping motor is driven once every twenty seconds.

Assuming now that the stem is pulled out to a first reset position at which switch 20 is closed, the reset terminal Res is driven to a high condition and the system reset control signal $S_R$ becomes high. Accordingly, the output of inverter 25 goes low thereby releasing the reset line of the 1/16 counter 19. 1/16 counter 19 then starts counting a single pulse every twenty seconds, which is the output of divider circuit 18. Additionally, the low output from inverter 25 prevents the 1/20 Hz signal output from divider circuit 18 from passing through AND gate 33. This halts driving pulse generator 34 so that a motor driving pulse $P_M$ is not generated at terminals $O_1$ and $O_2$. It is noted that at this point while the stepping motor has been stopped, oscillator circuit 17 is still running.

Figure 4:
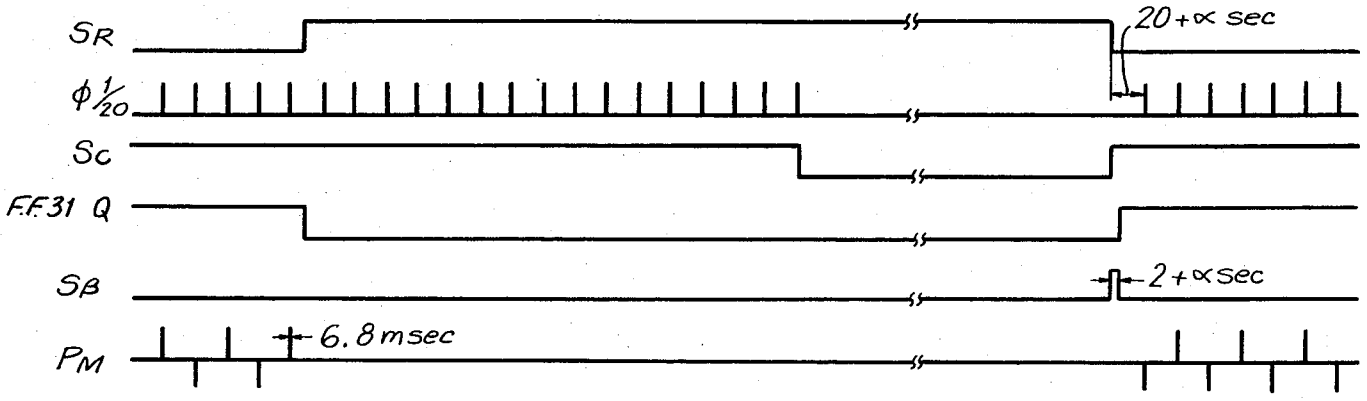
FIG. 4 is a timing diagram of the circuit of FIG. 3 when restart is longer than the period required for the 1/16 counter to convert to 16.

As can be seen in timing circuit FIG. 4, when the system reset signal goes high at the pulling out of the watch stem, counter 19 counts sixteen 1/20 Hz pulses. When the sixteenth pulse is counted, 320 seconds later, the output of counter 19 goes high and is inverted by inverter 26 providing a $S_C$ signal which is low thereby shutting down NAND gate 8 and stopping the oscillation of oscillator circuit 17. Additionally, at the sixteenth count, divider circuit 18 is reset by the signal provided through AND gate 27 and OR gate 28.

Referring again to FIG. 4 it can be seen that when the stem is pushed in to a normal operating position once again, switch 20 is open and reset signal $S_R$ goes low once again. At this point the output from inverter 25 becomes high and the 1/16 counter 19 is once again reset so that signal $S_C$ becomes high allowing NAND gate 8 to function as an inverter. Simultaneously, flip flop 31 in timing circuit 23 is released from a reset condition and signal $S_B$ becomes high for a duration of $2+\alpha$ seconds where $\alpha$ is the time needed until the start of oscillation. During this high point of signal $S_B$, controlled inverter 24 becomes activated. Since an additional amount of current is now available to crystal 1 through the output of inverter 24 and NAND gate 8, oscillation begins almost immediately and $\alpha$ or the amount of time until oscillation is very short. Additionally, the opening of switch 20 releases divider circuit 18 from its reset condition, so it can process the high frequency time standard into low frequency signals. Also, AND gate 33 is released so the 1/20 Hz timing signals may drive pulse generator 34.

Figure 5:
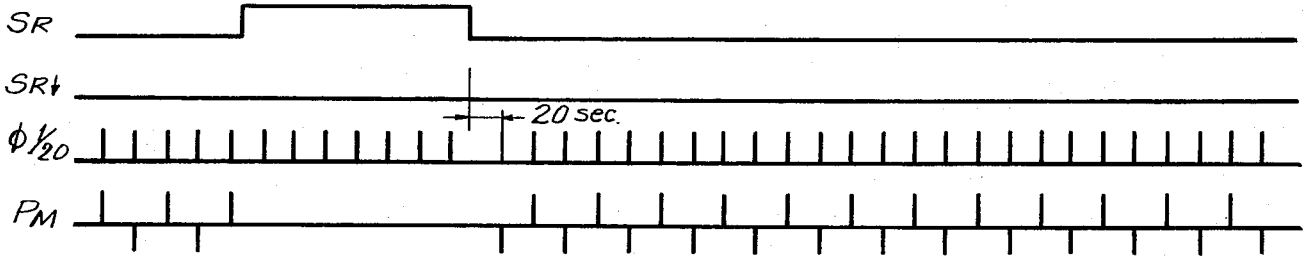
FIG. 5 is a timing diagram of the circuit of FIG. 3 when restart is less than the period for the 1/16 counter to convert to 16.

Referring now to FIG. 5 a timing sequence is illustrated wherein the time setting stem is pulled out for less than 320 seconds (16 counts). Once again reset signal $S_R$ becomes high and the 1/16 counter 19 starts counting the 1/20 Hz signal. Additionally, driving pulse generator 34 is halted by AND gate 33. However, in this case, counter 19 is reset before counting sixteen pulses so $S_C$ does not become low but remains high, and oscillation is not stopped. As soon as reset signal $S_R$ becomes low again the signal $S_R \downarrow$ becomes high for a duration of 1.95 miliseconds and divider circuit 18 is reset instantaneously through AND gate 27 and OR gate 28. Thereby, a 1/20 Hz pulse signal will be output precisely after 20 seconds and this will move the driving pulse generator at that time. Utilizing this technique, the setting of a watch may be synchronized with a knowon time standard by pushing in the setting stem precisely at the point of correct time.

Utilizing a circuit construction of the aforenoted description, an analog electronic timepiece may be provided wherein a stepping motor which drives analog hands is halted immediately when the watch enters a reset mode and oscillation of the oscillator circuit is halted 320 seconds later. In this way, power for oscillating, dividing and wave forming is not required so power consumption of the electronc circuit is reduced. Additionally, under a condition where oscillation has been stopped, the current provided to the oscillator during restart is larger than normal so oscillation will begin immediately and the error of time introduced to the start of operation of the stepping motor is small. Additionally, under a condition where the analog timepiece is reset in a time period of less than 320 seconds, while the stepping motor is halted, oscillation is not stopped and all counters are reset to zero when the stem is pushed in. This allows the timepiece to be set accurately to a known time standard.

It is to be noted while in the case of an analog timepiece having only an hour hand and a minute hand even if there is a delay between the setting of the watch and the restart of operation, there will be very little effect on the indicated time. Accordingly, even if oscillation of the oscillator is stopped immediately, and not after a period of 320 seconds, no significant error will be introduced.

Figure 6:
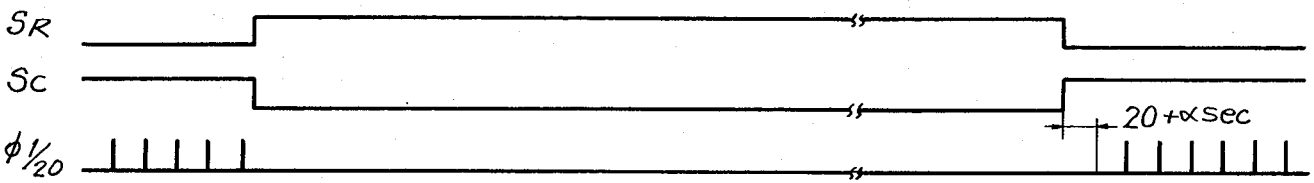
FIG. 6 is a timing diagram of another embodiment of the invention wherein the oscillator is turned off without delay.

Referring now to FIG. 6 a timing sequence for the construction of the above described embodiment is shown wherein oscillation is halted immediately upon pulling out the watch setting stem. In this case, the signal which is output from inverter 25 would be input to NAND gate 8 to stop oscillation instantaneously. System reset control signal $S_R$ would be input to the reset terminal of divider circuit 18, instead of the signal provided from OR gate 28, so that when the watch stem is pushed in oscillation begins immediately and all counters start from zero. In this construction as well, the current provided to the oscillator would be boosted when the timepiece is released from the reset condition by the added current from controlled inverter 24, which would be controlled by signal $S_B$ output from timer circuit 23. It is noted that this additional booster circuitry is not required in the case of an oscillator circuit which has a naturally fast start up time. In another embodiment of the invention, where it would be desired to provide an extra pulse of current to the oscillation circuit only when the oscillator was stopped and the electronic timepiece was released from a reset condition, the output signal of 1/16 counter 19 may be connected to the reset terminal of D type flip flop 31 instead of system reset signal $S_R$.

Additionally it is noted that in a construction made in accordance with the embodiments of the invention depicted in FIG. 3, the oscillator circuit is stopped when the analog electronic timepiece goes into a reset condition after 320 seconds have elapsed. This reset may occur at up to 320+20 seconds if reset occurs just after a 1/20 Hz signal has been output. This window of elapsed time until halting of oscillation may be changed freely depending on the construction of counter 19. It is also noted that the error of +20 seconds may be eliminated by resetting divider circuit 18 immediately when the stem is pulled out from the normal position to a first setting position.

In this embodiment, the extra current actuation signal $S_B$ delivered from timer circuit 23 remains high for $2+\alpha$ seconds after the analog timepiece is released from a reset condition where $\alpha$ is the time from reset to start of oscillation. In some instances it is necessary that this pulse width be longer than the time necessary to start the oscillator circuit and the length of this pulse may be determined by changing the signal input to the clock pulse terminal of D type flip flop 31.

Thus, according to the above noted construction and in accordance with the invention, an oscillator of an electronic timepiece may be stopped when placed into a reset mode so that the power consumption of the electronic circuit is reduced. As a result, an advantage is found in that the effect of economizing power consumption during shipping and stocking periods or during an unused period of time for the watch will be improved and the total battery life of an analog timepiece can be made longer.

In the description of the embodiment disclosed in this invention, reference is made to an analog timepiece having only an hour hand and a minute hand whose hands advance one step every 20 seconds. It is realized however that this invention would also apply to an analog electronc timepiece having an hour hand, a minute hand and a second hand, whose hands advance one step every one second and the effects obtained from a construction made according to the invention would also be available. Further, with reference to an analog timepiece having an hour hand and a minute hand, the invention is available not only for a timepiece whose hands advance one step every 20 seconds but also for a timepiece whose hands advance one step every five seconds, ten seconds, one minute, etc.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An analog display timepiece comprising:

oscillator means for providing a high frequency time standard signal;

divider circuit means for providing at least one low frequency time signal in response to said high frequency time standard signal from said oscillator means;

analog time display means;

analog time display driving means coupled to said analog time display means for advancing said time display means;

driving pulse generator means for generating a driving signal for driving said analog time display driving means in response to said low frequency time signal from said divider circuit means;

system reset control means for generating a system reset control signal indicating that said analog display timepiece is disposed in one of an operational mode and a reset mode;

oscillator stopping means for stopping the operation of said oscillator means at least in part in response to said system reset control signal indicating that said timepiece has been disposed into a reset mode;

booster means coupled to the oscillator means for temporarily providing an increased pulse of current to restart the oscillator means when going to the operational mode from the reset mode, said system reset control means including switch means actuatable between one of an on position and an off position by an externally operable member, delay counter means disposed between the divider circuit means and the oscillator stopping means for counting signal from the divider circuit means when the switch means is turned on and then transmitting an oscillation stopping signal to said oscillator stopping means after a fixed period has passed;

differentiation circuit means for outputting a reset differentiation signal to said divider circuit when said switch means is disposed in an off position before said delay counter means counts the passage of the fixed period; and timer circuit means for outputting an operational signal for a fixed period to the booster means synchronized with the time when the switch is disposed in an off position and the operational signal delivered from said timer circuit ceases before a first driving pulse is outputted from the driving pulse generator means when the timepiece is switched from the reset mode to the operational mode.

2. The analog display timepiece, as claimed in claim 1, further comprising driving pulse generator gating means coupled between said divider circuit means and said driving pulse generator means, said gating means being coupled to stop the operation of said driving pulse generator means in response to said system reset control signal.

3. The analog display timepiece, as claimed in claim 1, wherein said counting signal is said low frequency time signal and said delay counter means actuates said oscillator stopping means after 16 counts.

4. The analog display timepiece, as claimed in claim 1, wherein said divider circuit means is reset in response to said system reset control signal indicating that said timepiece has been set into a reset mode and said oscillator stopping means has been actuated.

5. The analog display timepiece, as claimed in claim 1, wherein said oscillator means includes a quartz crystal oscillator having a gate terminal.

6. The analog display timepiece, as claimed in claim 5, wherein said oscillator stopping means includes gate means coupled between the gate terminal of said quartz oscillator and the output of said oscillator means and adapted to be rendered non-conductive at least in part in response to said system reset control signal.

7. The analog display timepiece, as claimed in claim 5, wherein said oscillator stopping means is formed of gate-controlled MOS transistor means defining the DC current bias resistor of said oscillator means, said DC current bias resistor being rendered non-conductive in response to the application of a stopping signal to the gate thereof representative, at least in part, to said system reset control signal indicating that said timepiece has been reset.

8. The analog display timepiece, as claimed in claim 1, wherein said oscillator means includes a gate capacitor and said oscillator stopping means further includes MOS transistor means copuled with its source-drain path shorting said gate capacitor so that said gate capacitor is short circuited in response to said stopping signal.

9. The analog display timepiece, as claimed in claim 5, wherein said oscillator means includes a phase shifting resistor coupled in series with said oscillator and an inverter for oscillation coupled across said oscillator and phase shift resistor, said inverter being formed of a complementary pair of MOS transistors, said oscillator stopping means including a further MOS transistor with its source-drain path in series with the sourcedrain path of said transistors defining said inverter, said further MOS transistor being rendered non-conductive in response to a stopping signal representative, at least in part, to said system reset control signal indicating that said timepiece has been stopped.

10. The analog display timepiece, as claimed in claim 9, wherein said oscillator stopping means further includes a still further MOS transistor and a bias voltage source, said still further MOS transistor having its source-drain paths coupled between said bias voltage source and the output of said inverter and adapted to be rendered conductive by said stopping signal.

11. A driving circuit for an analog display timepiece comprising:

oscillator means for providing a high frequency time standard signal;

divider circuit means for providing at least one low frequency time signal in response to said high frequency time standard signal from said oscillator means;

analog time display driving means for advancing an analog time display.

driving pulse generator means for generating a driving signal for driving said analog time display driving means in response to said low frequency time signal from said divider circuit means;

system reset control means for generating a system reset control signal indicating that said analog display driving circuit is disposed in one of an operational mode and a reset mode;

oscillator stopping means for stopping the operation of said oscillator means at least in part in response to said system reset control signal indicating that said driving circuit has been disposed into a reset mode;

booster means coupled to the oscillator means for temporarily providing an increased pulse of current to restart the oscillator means when going to the operational mode from the reset mode, said system reset control means including switch means actuatable between one of an on position and an off position by an externally operable member, delay counter means disposed between the divider circuit means and the oscillator stopping means for counting a counting signal from the divider circuit means when the switch means is turned on and then transmitting an oscillation stopping signal to said oscillator stopping means after a fixed period has passed;

differentiation circuit means for outputting a reset differentiation signal to said divider circuit when said switch means is disposed in an off position before said delay counter means counts the passage of the fixed period; and timer circuit means for outputting an operational signal for a fixed period to the booster means synchronized with the time when the switch means is disposed in an off position and the operational signal delivered from said timer circuit ceases before a first driving pulse is outputted from the driving pulse generator means when the timepiece is switched from the reset mode to the operational mode.

12. The driving circuit for an analog display timepiece, as claimed in claim 11, further comprising driving pulse generator gating means coupled between said divider circuit means and said driving pulse generator means, said gating means being coupled to stop the operation of said driving pulse generator means in response to said system reset control signal.

13. The driving circuit for an analog display timepiece, as claimed in claim 3, wherein said counting signal is said low frequency time signal and said delay counter means actuates said oscillator stopping means after 16 counts.

14. The driving circuit of an analog display timepiece, as claimed in claim 11, wherein said divider circuit means is reset in response to said system reset control signal indicating that said driving circuit has been set into a reset mode and said oscillator stopping means has been actuated.

15. The driving circuit of an analog display timepiece, as claimed in claim 11, wherein said oscillator means includes a quartz crystal oscillator having a gate terminal.

16. The driving circuit for an analog display timepiece, as claimed in claim 15, wherein said oscillator stopping means includes gate means coupled between the gate terminal of said quartz oscillator and the output of said oscillator means and adapted to be rendered non-conductive at least in part in response to said system reset control signal.

17. The driving circuit of an analog display timepiece, as claimed in claim 15, wherein said oscillator stopping means is formed of gate-controlled MOS transistor means defining the DC current bias resistor of said oscillator means, said DC current bias resistor being rendered non-conductive in response to the application of a stopping signal to the gate thereof representative, at least in part, to said system reset control signal indicating that said driving circuit has been reset.

18. The driving circuit of an analog display timepiece, as claimed in claim 11, wherein said oscillator means includes a gate capacitor and said oscillator stopping means further includes MOS transistor means coupled with its source-drain path shorting said gate capacitor so that said gate capacitor is short circuited in response to said stopping signal.

19. The driving circuit of an analog display timepiece, as claimed in claim 15, wherein said oscillator means includes a phase shifting resistor coupled in series with said oscillator and an inverter for oscillation coupled across said oscillator and phase shift resistor, said inverter being formed of a complementary pair of MOS transistors, said oscillator stopping means including a further MOS transistor with its source-drain path in series with the source-drain path of said transistors defining said inverter, said further MOS transistor being rendered non-conductive in response to a stopping signal representative, at least in part, to said system reset control signal indicating that said driving circuit has been stopped.

20. The driving circuit of an analog display timepiece, as claimed in claim 19, wherein said oscillator stopping means further includes a still further MOS transistor and a bias voltage source, said still further MOS transistor having its source-drain paths coupled between said bias voltage source and the output of said inverter and adapted to be rendered conductive by said stopping signal.

* * * * *